United States Patent [19]

Tsukasaki

[11] Patent Number: 4,471,693

[45] Date of Patent: Sep. 18, 1984

[54] APPARATUS FOR FEEDING CARDBOARDS TO A CARTON MAKING SECTION

[75] Inventor: Yasuhiro Tsukasaki, Osakashi, Japan

[73] Assignee: Kabushiki Kaisha Shinko Kikai Seisakusho, Osaka, Japan

[21] Appl. No.: 526,382

[22] Filed: Aug. 24, 1983

[30] Foreign Application Priority Data

Aug. 27, 1982 [JP] Japan ..... 57-130006[U]
May 24, 1983 [JP] Japan ..... 58-78730[U]

[51] Int. Cl.[3] ..... B41F 5/16

[52] U.S. Cl. ..... 101/183; 493/321; 493/324; 271/42

[58] Field of Search ..... 101/183–184, 101/216–218, 229–232, 247–248; 493/321, 324; 271/42, 131, 139, 140, 84

[56] References Cited

U.S. PATENT DOCUMENTS

| | | | |
|---|---|---|---|
| 1,850,800 | 3/1932 | Langston et al. | 101/183 X |
| 1,850,802 | 3/1932 | Langston et al. | 101/183 X |
| 1,977,812 | 10/1934 | Swift, Jr. | 101/184 |
| 2,181,211 | 11/1939 | Sieg | 493/321 |
| 2,191,988 | 2/1940 | Greenwood | 493/324 X |
| 3,269,590 | 8/1966 | Harter | 271/42 X |
| 3,377,063 | 4/1968 | Kirby | 27/42 X |
| 3,611,925 | 10/1971 | Kulwicki | 101/183 |
| 3,648,605 | 3/1972 | Hottendorn | 101/183 X |
| 3,999,454 | 12/1976 | Tiso et al. | 493/324 X |

FOREIGN PATENT DOCUMENTS

| | | | |
|---|---|---|---|
| 1522859 | 10/1969 | Fed. Rep. of Germany | 271/42 |
| 959588 | 6/1964 | United Kingdom | 271/42 |

*Primary Examiner*—E. H. Eickholt
*Attorney, Agent, or Firm*—Birch, Stewart, Kolasch & Birch

[57] ABSTRACT

An apparatus of feeding cardboards to a carton making section in the course of which they are individually printed in ink of different colors station by station, the apparatus including a conveyor unit located between each adjacent stations, which conveyor unit comprises an upper conveyor and a lower conveyor adapted to hold the cardboards therebetween, at least one of the upper conveyor or the lower conveyor including spikes projecting toward the cardboards held thereon, thereby securing the transferring of the cardboards from station to station.

2 Claims, 10 Drawing Figures

APPARATUS FOR FEEDING CARDBOARDS TO A CARTON MAKING SECTION

BACKGROUND OF THE INVENTION

The present invention relates to an apparatus of feeding cardboards to a carton making section, and more particularly, to an apparatus of feeding cardboards to a carton making section, in the course of which they are individually printed in ink of different colors station by station.

When multi-color printing is carried out on cardboards station by station, it is essential to cause no displacement of the cardboards in transit; otherwise a misprinting will result and spoil the appearance of cartons. However, owing to the warps inherent to the cardboards and a slipping occurring on the conveyor, a misprinting, such as discontinuity of printed lines or stain, often happens. So far no solution to this problem has been found.

In a series of printing process it is sometimes necessary to suspend the operation of some station or others, for example, for repairing or ink-filling. In this case, the printing roller at the station is kept away from the impression cylinder, which means that the feeding path has an inoperative part at which a cardboard, especially a shorter one, is left from feeding. In spite of the fact that there is an inoperative station, the cardboards must be continuously fed.

OBJECTS AND SUMMARY OF THE INVENTION

The present invention is toward solving the problems pointed out above and has for its object to provide an improved cardboards feeding apparatus capable of transferring same from station to station without causing a displacement thereof, thereby ensuring that multicolor printing is beautifully carried out on the cardboards.

Another object of the present invention is to provide an improved cardboard feeding apparatus allowing the cardboards to be transferred from station to station even when the feeding line has an inoperative station, thereby securing a continuous feeding of the cardboards.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to one aspect of the present invention, there is provided an apparatus of feeding cardboards to a carton making section, the apparatus comprising:

- a kicker movable forward and backward along the cardboard feeding path;
- a plurality of printing stations, each station including a printing roller and an impression cylinder, wherein the printing rollers have a diameter of the same length;
- a cardboard process section including a pair of marking rollers and a pair of slotting rollers;
- a driving means for rotating the printing rollers, the marking rollers and the slotting roller in a synchronous manner;

- a conveyor unit located between each adjacent stations, the conveyor unit including an upper conveyor and a lower conveyor arranged so as to hold the cardboards therebetween; and
- at least one of the upper conveyor or the lower conveyor including spikes projecting toward the cardboards held therebetween.

According to another aspect of the present invention, there is provided an apparatus of feeding cardboards to a carton making section, the apparatus comprising:

- a kicker movable forward and backward along the cardboard feeding path;
- a plurality of printing stations, each station including a printing roller and an impression cylinder, wherein the printing rollers have a diameter of the same length;
- a cardboard process section including a pair of marking rollers and a pair of slotting rollers;
- a driving means for rotating the printing rollers, the marking rollers and the slotting roller in a synchronous manner;
- a conveyor unit located between each adjacent stations, the conveyor unit including an upper conveyor and a lower conveyor arranged so as to hold the cardboards therebetween;
- at least one of the upper conveyor or the lower conveyor including spikes projecting toward the cardboards held therebetween; and
- the upper conveyor including means for enabling same to shift along the cardboard feeding path, thereby shortening the distance between the adjacent upper conveyors.

DETAILED DESCRIPTION OF THE INVENTION

Figure 1:
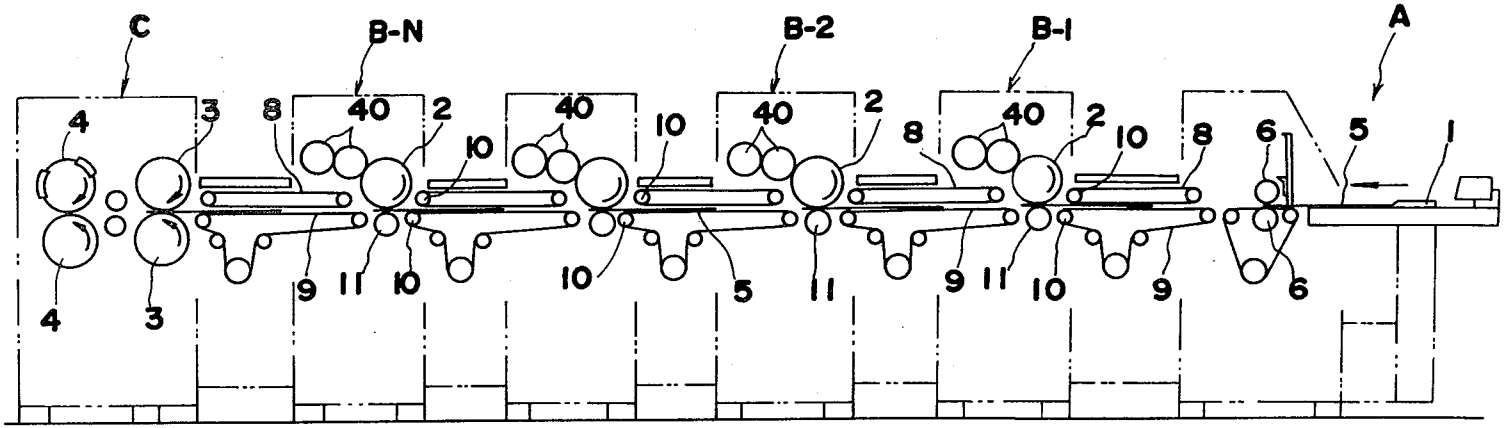
FIG. 1 is a schematic side view showing an apparatus embodying the present invention.
Figure 2:
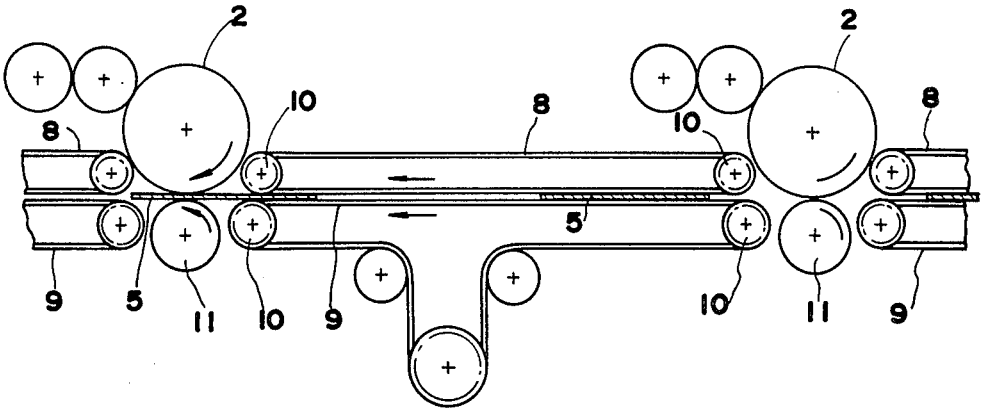
FIG. 2 is a side view on an enlarged scale showing a cardboard feeding path between adjacent stations.

FIG. 1 illustrates an entire line along which cardboards 5 are fed and printed in different color ink station by station, wherein the stations are indicated by the reference characters B-1, B-2 . . . B-N. The cardboards 5 are individually pushed or launched on the line by a kicker 1 capable of moving forward and backward. Each of the stations is provided with a printing drum 2, which has a diameter of the same length. The line ends at a processing section C in which a pair of marking rollers 3 and a pair of slotting rollers 4 are provided. The cardboard 5 is caught by a pair of feed rollers 6, and supplied to the first station B-1 at which the first printing is performed on the cardboard 5. In this way the cardboard 5 is fed from station to station, and finally reaches the processing section C at which the marking is performed, followed by engraving folding slots on the cardboards by means of the slotting rollers 4.

The kicker 1, the printing drums 2, the marking rollers 3 and the slotting rollers 4 are synchronously rotated. The reference numerals 8 and 9 designate timing belts, which are provided with teeth 7 on their inner surfaces as best shown in FIG. 4.

Figure 4:
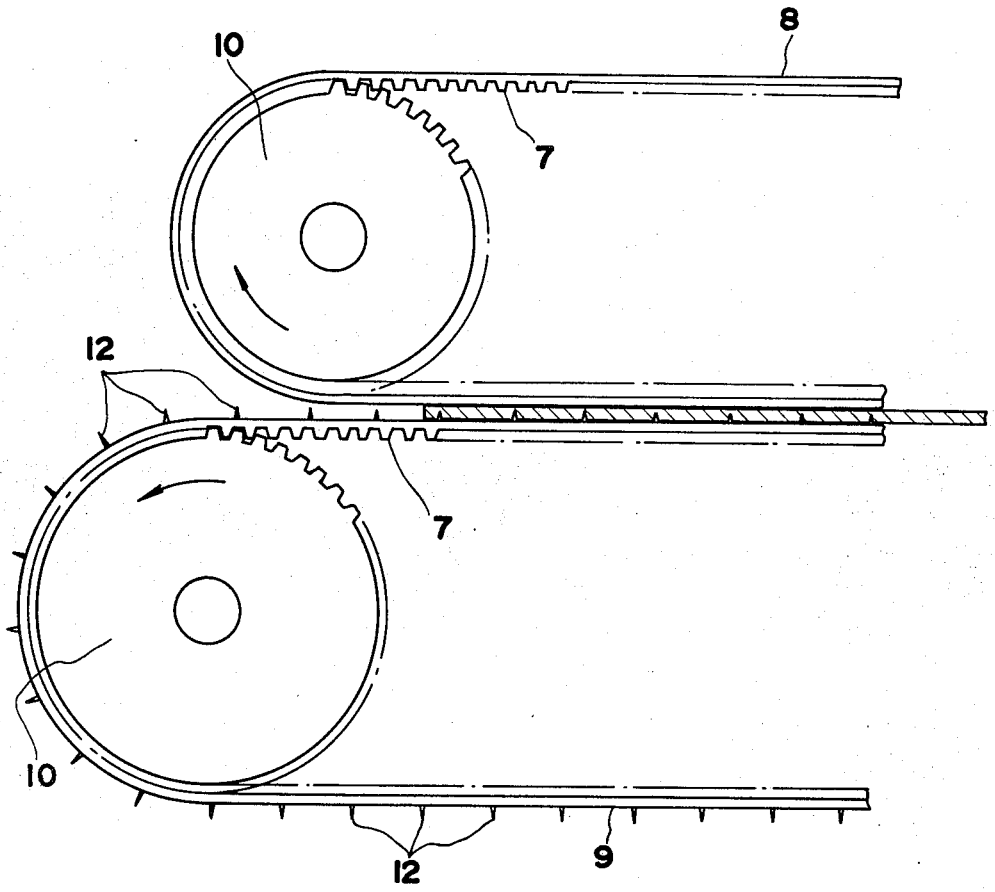
FIG. 4 is a side view on an enlarged scale showing the relationship between the upper conveyor and the lower conveyor.
Figure 5:
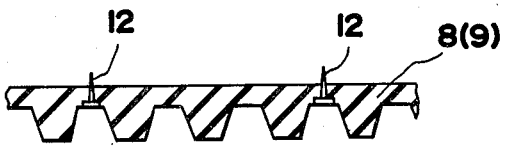
FIG. 5 is a fragmentary cross-section on an enlarged scale showing the structure of the belt used in the lower conveyor shown in FIG. 4.

Referring to FIG. 4, the timing belts 8 and 9 will be described in greater detail: The upper timing belt 8 and the lower timing belt 9 are arranged with the cardboard path being interlocated therebetween. The timing belts 8 and 9 are provided between the adjacent stations B-1 and B-2; B-2 and B-3 . . . B-N-1 and B-N, so as to bridge between the adjacent stations. The timing belt 8 is made as long as by integral multiplication of the circumference of the printing roller 2, preferably in the range of the same to three times. Each timing belt 8, 9 is carried on sprockets 10, which are rotated at the same speed as those for the printing rollers 2. Either of the timing belts 8 or 9 is provided with spikes 12 so as to secure the cardboard on its surface. The spikes 12 are planted as shown in FIG. 5.

As described above, the upper timing belt 8 is made as long as by integral multiplication of the circumference of the printing roller 2. This is effective to avoid transferring of an ink stain on the timing belt 8 onto the cardboards 5 which subsequently come to this station. Under the dimentional relationship between the timing belt 8 and the printing roller 2 one ink stain on the timing belt 8 safely falls on a spot at which the next printing is made.

Figure 3:
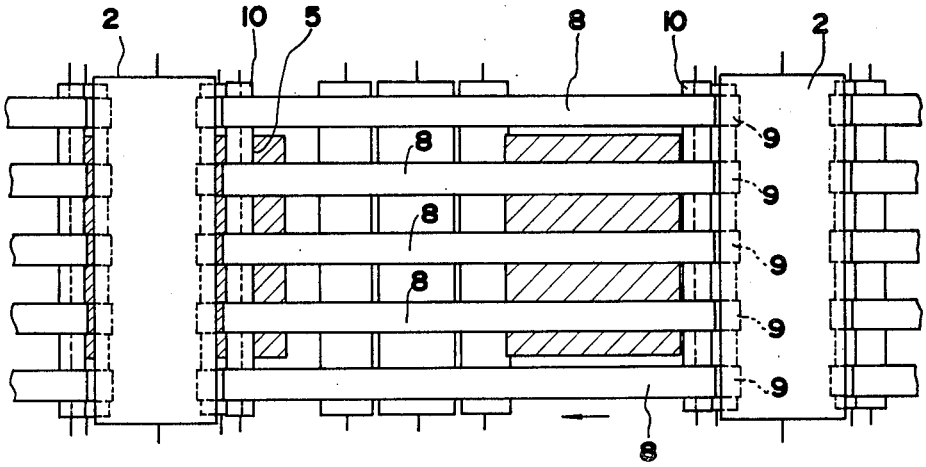
FIG. 3 is a plan view of the portion shown in FIG. 2.
Figure 6:
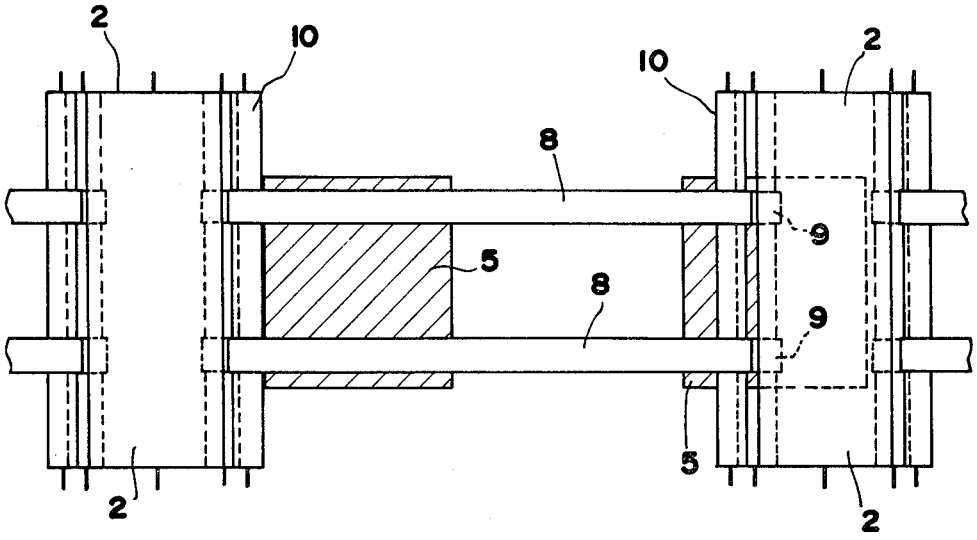
FIG. 6 is a plan view showing a modified version of the arrangement of the upper conveyor and the lower conveyor.

It is possible to provide several pairs of timing belts 8, 9 as shown in FIG. 3 or a pair of them located at opposite end portions of the cardboard path as shown in FIG. 6. In the latter case it is necessary to provide the pair of timing belts 8 with a width adjusting device whereby the space therebetween can be adjusted in accordance with the widths of the cardboards to be treated. The gaps between the timing belts 8 and 9, between the feed rollers 6 and between the printing roller 2 and an impression cylinder 11 are respectively predetermined in accordance with the sizes of the cardboards 5.

Figure 7:
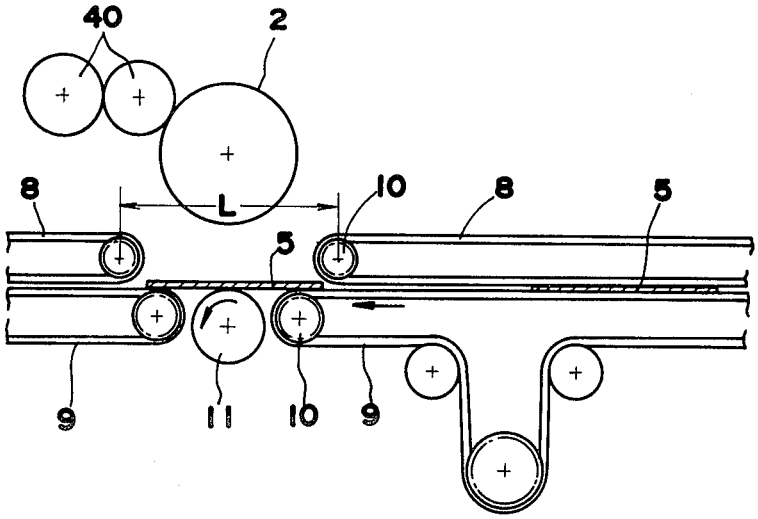
FIG. 7 is a side view showing a printing station kept in off-operation.

FIG. 7 illustrates a situation at which one printing station is stopped from the printing operation while other printing stations are in operation. As shown in FIG. 7, the printing roller 2 is raised so as to come out of contact from the impression cylinder 11. In this case, however, the problem is that if the cardboard 5 is shorter than the distance L between the terminating end of the previous timing belt 8 and the starting end of the next timing belt 8, the cardboard 5 is likely to be left from feeding and remain on the impression cylinder 9 as shown in FIG. 3. In order to solve this problem, a special device is provided in the timing belts 8.

Figure 8:
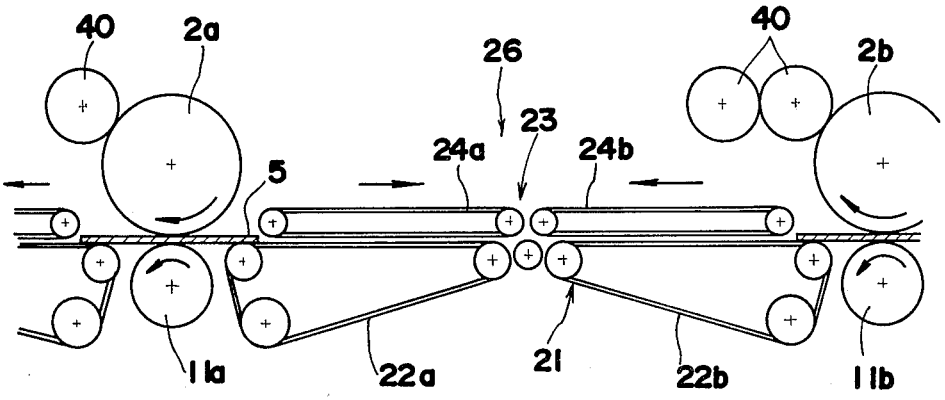
FIG. 8 is a side view showing an alternative embodiment, corresponding to FIG. 2.
Figure 9:
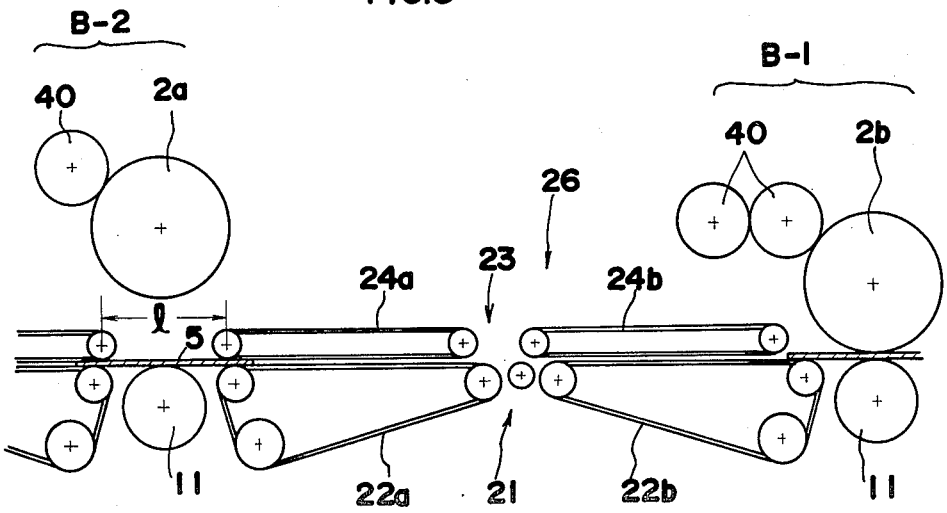
FIG. 9 is a side view exemplifying the operation of the embodiment of FIG. 8.
Figure 10:
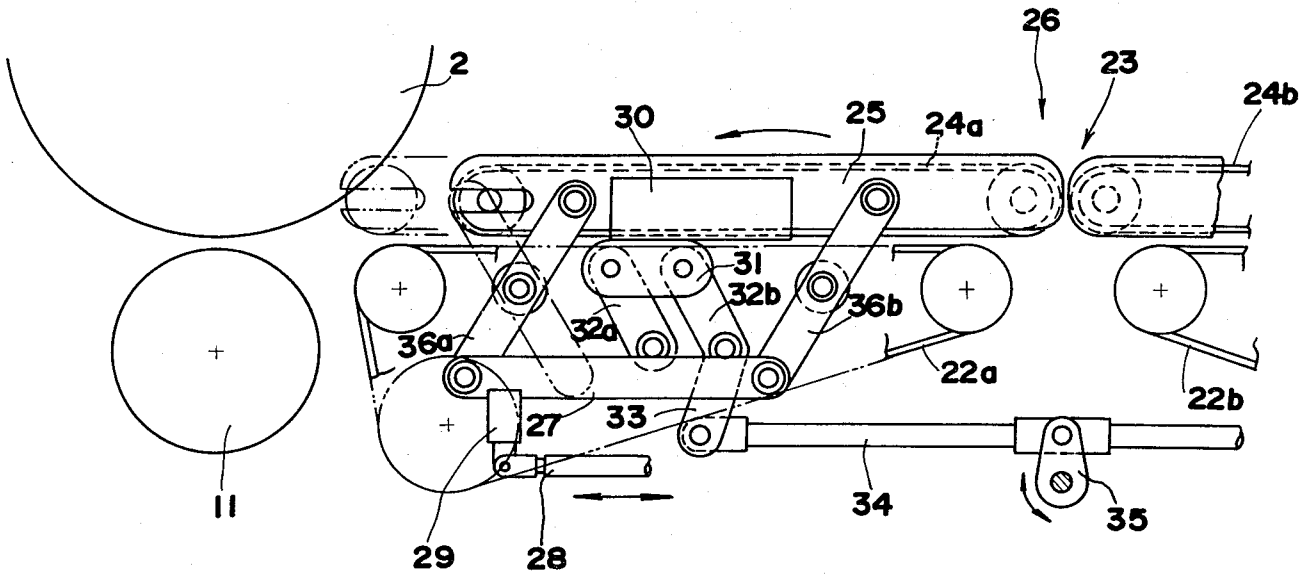
FIG. 10 is a side view on an enlarged scale showing a shifting mechanism employed in the embodiment of FIG. 8.

Referring to FIGS. 8 to 10, the special device will be more particularly described: There are provided an upper conveyor unit 23 and a lower conveyor unit 21 between the adjacent two printing rollers 2*a* and 2*b*. The upper conveyor unit 23 consists of component units 24*a* and 24*b*, and the lower conveyor unit 21 consists of component units 22*a* and 22*b*. The entire arrangement including both conveyor units 21 and 23 is generally designated by the reference numeral 26, hereinafter referred to as the conveyor arrangement. The starting end of the component unit 22*b* and the terminating end of the component unit 22*a* are located adjacent to the impression cylinders 11*a* and 11*b*. The component units 24*a* and 24*b* are provided in such a manner as to be movable along the cardboard feeding path. In FIG. 8 the two component units 24*a* and 24*b* are located nearest to each other, whereas in FIG. 9 they are separated at maximum, so as to make the distance shorter than the length of the cardboard 5. The shifting of the component units 24*a*, 24*b* is performed in the manner illustrated in FIG. 10, which will be described in detail below:

Referring to FIG. 10, reference will be made only to the component unit 24*a*, but it should be understood that the component unit 24*b* has the same mechanism as that of the component unit 24*a*. The component unit 24*a* is provided with a side support 25 to which a pair of arms 36*a*, 36*b* are pivotally jointed. Each arm 36*a*, 36*b* is pivotally supported at its center around which the arm can rotate, and is pivotally jointed to a link member 27 at its other terminating end. The link member 27 is provided with a bracket 29 to which a piston rod of a pneumatic cylinder 28 is secured. When the piston rod is moved in the left-hand and the right-hand directions, the arms 36*a* and 36*b* are caused to swing around the respective pivots, thereby enabling the component unit 24*a* to shift to the left and the right. The side support 25 is provided with a stopper bracket 30 projecting therefrom. The stopper bracket 30 has a mating bar 31 kept in contact with the bottom thereof. The stopper bracket 30 and the bar 31 are designed to regulate the side support 25 (accordingly, the component unit 24*a*) to take a position in the vertical direction. The bar 31 is provided with a pair of swinging arms 32*a* and 32*b*, one of which is connected to a crank 35 through an intermediate link 33 and a rod 34. By rotating the crank 35, the swinging arms 32*a*, 32*b* are caused to rotate in a clockwise or a counter-clockwise direction in FIG. 10, thereby raising or lowering the position of the side support 25 and accordingly, the upper component unit 24*a*. This allows a thick cardboard 5 or a thin cardboard 5 to be appropriately located in between the upper and the lower component units 24*a* and 22*a*.

Referring to FIG. 9, at the station B-2 the printing roller 2*a* is raised to suspend a printing operation, whereas at the station B-1 the printing is carried out. If the length of the cardboard 5 is shorter than l, it is necessary to shift the upper component unit 24*a* to the left so as to enable same to come near to the upper component unit 24*b* of the station B-2. This saves the short cardboard from slipping off the conveyor line.

What is claimed is:

1. An apparatus of feeding cardboards to a carton making section, the apparatus comprising:

a kicker movable forward and backward along the cardboard feeding path;

a plurality of printing stations, each station including a printing roller and an impression cylinder, wherein the printing rollers have a diameter of the same length;

a cardboard process section including a pair of marking rollers and a pair of slotting rollers;

a driving means for rotating the printing rollers, the marking rollers and the slotting roller in a synchronous manner;

a conveyor unit located between each adjacent stations, the conveyor unit including an upper conveyor and a lower conveyor arranged so as to hold the cardboards therebetween; and at least one of the upper conveyor or the lower conveyor including spikes projecting toward the cardboards held therebetween.

2. An apparatus as defined in claim 1, wherein the upper conveyor includes means for enabling same to shift to the left or the right along the cardboard feeding path, thereby shortening the distance between the adjacent upper conveyors.

* * * * *